US005348232A

United States Patent [19]

Babitzka et al.

[11] Patent Number: 5,348,232

[45] Date of Patent: Sep. 20, 1994

[54] ELECTROMAGNETICALLY ACTUATED FUEL ATOMISING AND METERING VALVE FOR A HEAT ENGINE FUEL SUPPLY DEVICE

[75] Inventors: Rudolf Babitzka, Savigno; Marcello Cristiani, Imola, both of Italy

[73] Assignee: Weber S.r.l., Turin, Italy

[21] Appl. No.: 960,536

[22] Filed: Oct. 13, 1992

[30] Foreign Application Priority Data

Oct. 11, 1991 [IT] Italy ..... TO91A000771

[51] Int. Cl.[5] ..... F02M 51/00

[52] U.S. Cl. ..... 239/585.4; 239/600; 29/890.127; 29/890.132; 251/129.21; 335/126

[58] Field of Search ..... 239/585.3, 585.4, 585.5, 239/585.1, 533.12, 600; 29/602.1, 890.12, 890.127, 890.129, 890.131, 890.132, 527.4; 251/368, 129.21, 129.15; 137/375; 335/126, 131

[56] References Cited

U.S. PATENT DOCUMENTS

| | | | |
|---|---|---|---|
| 4,360,161 | 11/1982 | Claxton et al. | 239/585.4 |
| 4,666,088 | 5/1987 | Krauss et al. | 239/585.3 |
| 4,688,723 | 8/1987 | Kern et al. | 239/585.3 |
| 4,711,400 | 12/1987 | Radaelli et al. | 239/585.4 |
| 4,934,605 | 6/1990 | Hans et al. | 239/585.4 |
| 5,012,983 | 5/1991 | Buchholz et al. | 239/585.1 |
| 5,033,716 | 7/1991 | Mesenich | 239/585.3 |

FOREIGN PATENT DOCUMENTS

| | | | |
|---|---|---|---|
| 4018256 | 12/1991 | Fed. Rep. of Germany . | |
| 2632019 | 12/1989 | France . | |
| 1566062 | 5/1990 | U.S.S.R. | 239/585.4 |
| 2240137 | 7/1991 | United Kingdom | 239/553.12 |

*Primary Examiner*—Karen B. Merritt
*Attorney, Agent, or Firm*—Baker & Daniels

[57] ABSTRACT

The present invention involves an electromagnetically actuated fuel atomizing and metering valve. The valve has a metal body housing an electromagnet, a core, and an injection nozzle. The injection nozzle has at least one fuel injection orifice passage controlled by a movable shutter member fixed to an armature. The shutter member controls the passage of fuel through the injection orifice and comprises a disc delimited by a cylindrical outer lateral surface which has substantially the same diameter as the outer surface of the armature. The disc is connected to the armature by laser welding between the upper circular edge of the disc and the lower circular edge of the armature.

11 Claims, 2 Drawing Sheets

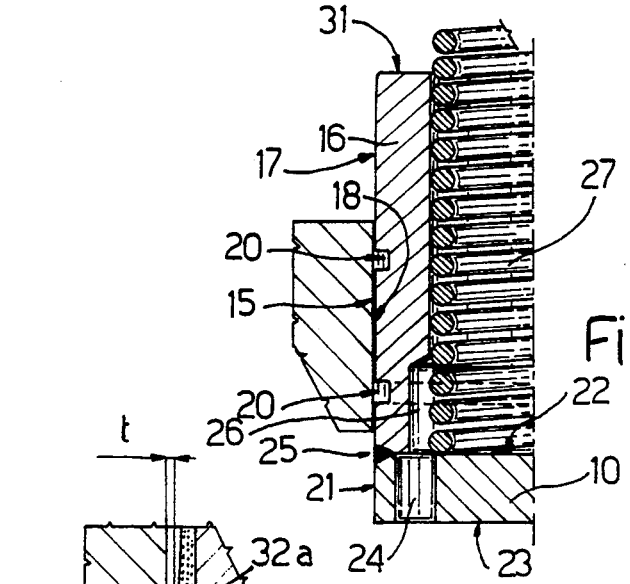
Fig.4
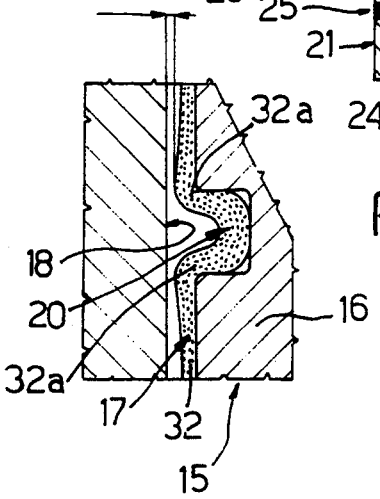
Fig.5
Fig.6
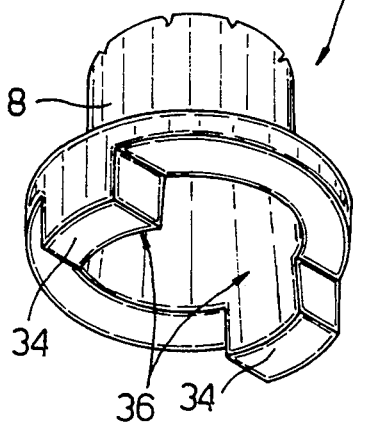
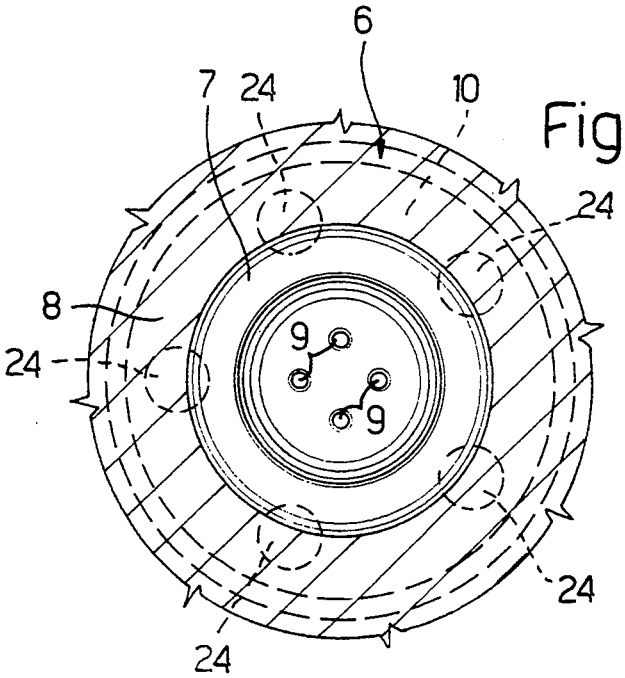
Fig.3

ELECTROMAGNETICALLY ACTUATED FUEL ATOMISING AND METERING VALVE FOR A HEAT ENGINE FUEL SUPPLY DEVICE

BACKGROUND OF THE INVENTION

The present invention relates to an electromagnetically actuated fuel atomising and metering valve for a heat engine fuel supply device.

A valve of this type substantially comprises a metal body in which is housed an annular electromagnet and a core disposed within the electromagnet, as well as an injection nozzle which is provided with at least one fuel injection orifice and which is fixed to the said body. A valve of this type further includes a shutter member movable between a first position in which it closes the fuel passage through the injection opening and a second position in which it leaves this passage open; the shutter member is normally fixed to a tubular armature which can be attracted by the core and which is provided with a cylindrical outer surface arranged to slide on a corresponding surface of the opening in the valve body.

Valves of the type briefly described have several disadvantages.

Above all, these can have an insufficient speed of response, especially when they have to operate at a particularly high frequency. This disadvantage is due to the structure of the assembly constituted by the shutter member itself, and by the armature which is fixed to it; in fact, because of the shape of these two parts and the members which are necessary to connect them together the mass of the assembly thus formed can be excessively high; moreover, the magnetic flux linkage between the armature and the valve body can be poor because of the high value of the radial clearance (air gap) which must be left between the outer surface of the armature and the inner surface of the opening in the body which constitutes the guide for the movement of the armature itself; in fact, the value of this clearance depends on the working tolerances of the surfaces, which tolerances cannot be made stricter.

Moreover, the valve seal may also be unsatisfactory: this disadvantage is due to small errors in mounting the shutter member proper onto the armature and which are due to the manner in which mounting is performed (normally by plastic deformation of parts of the armature) to achieve this connection; moreover an unsatisfactory seal is also sometimes consequent on an incorrect surface roughness of the active surface of the shutter member and that of the seat with which it comes into contact when the valve is in its closed position.

Finally, small drops of fuel can form on such valves downstream of the injection opening which, by mixing with the flow of fuel and air mixture, which is supplied to the engine can vary the operating conditions thereof, in particular in slow running conditions; this disadvantage is due to the fact that the jet of fuel leaving the injection opening strikes a surface which is formed within the valve nozzle; during the impact between the jet and this surface the fuel is atomised, but part of it can run off tangentially on the surface itself collecting into droplets which can then drop off it and be conveyed into the fuel and air mixture.

Finally, the structure of valves of the type indicated is normally rather complex because of the shape of some of the parts of the valve and the type of connections which are provided for mounting them.

SUMMARY OF THE INVENTION

The object of the present invention is that of providing an electromagnetically actuated fuel atomising and metering valve of the type briefly described, which will be free from the disadvantages which have been described.

Therefore, according to the invention there is provided an electromagnetically actuated fuel atomising and metering valve for a heat engine fuel supply device, substantially comprising a metal body within which is housed an annular electromagnet and a core disposed within the electromagnet, an injection nozzle which is provided with at least one fuel injection orifice and which is fixed to the said body and a shutter member movable between a first position in which it closes the fuel passage through the injection orifice, and a second position in which it leaves this passage open, the said shutter member being fixed to a tubular armature adapted to be attracted by the said core and provided with an outer cylindrical surface adapted to slide on a corresponding surface of a bone in the said body, characterised by the fact that the said shutter member is constituted by a disc delimited by a cylindrical outer lateral surface having substantially the same diameter as the said outer surface of the said armature and by a pair of upper and lower flat circular surfaces, the said disc being connected to the said armature, by laser welding effected between the circular edge of the said upper surface of the disc and the corresponding edge of the lower surface of the armature and the said disc being provided with at least once axial hole passing through which traverses the disc itself.

BRIEF DESCRIPTION OF THE DRAWINGS

For a better understanding of the structure of the valve of the invention a more detailed description of an embodiment will now be given with reference to the attached drawings, in which:

FIG. 3 is a section of the valve of FIG. 1 taken on the line III—III;

FIG. 4 is a partial section of the shutter member of the valve which corresponds to a different embodiment from that illustrated in FIG. 1;

FIG. 5 is an enlarged detail of FIG. 4; and

FIG. 6 is a perspective view of the lower part of the injection nozzle of the valve.

DETAILED DESCRIPTION OF THE INVENTION

Figure 1:
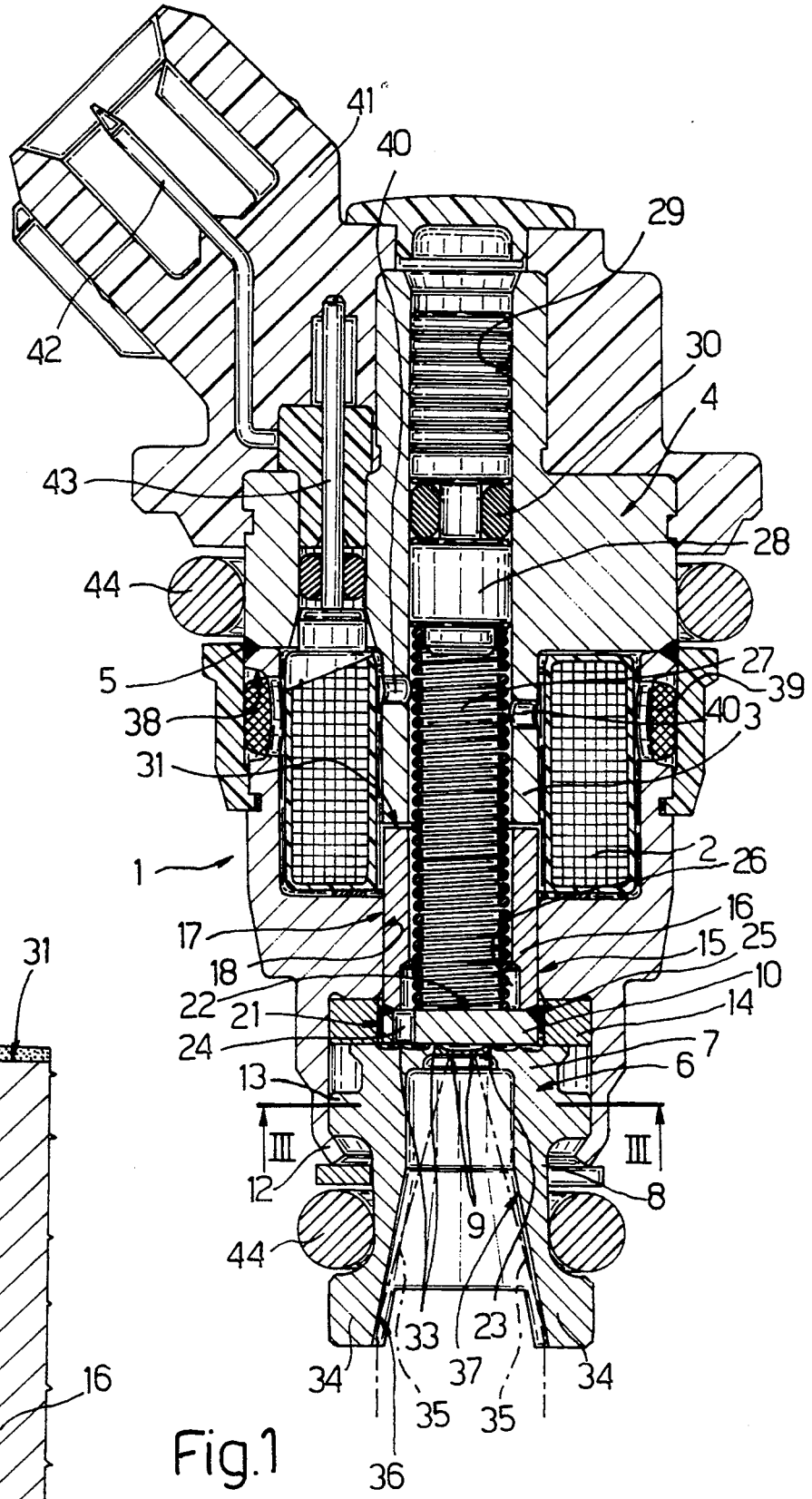
FIG. 1 is an axial section of the valve of the invention.

The valve of the invention, shown in FIG. 1, substantially comprises a metal body 1 within an internal cavity of which is housed an annular electromagnet 2 and a core 3, also of annular shape, disposed within the electromagnet itself.

Conveniently this core projects axially from a disc 4 which is fixed to the body 1 by laser welding 5.

The valve further includes a cup shape injection nozzle 6 as can be seen clearly in FIG. 1, having an upper wall 7 and a side wall 8, in the first of which is formed at least one injection orifice 9. The said nozzle is fixed to the body 1 by means of an end collar 12 of the body 1 which is upset onto a corresponding annular projection 13 of the nozzle itself; moreover, as is clearly seen from the drawing a spacer washer 14 is disposed between the body 1 and the nozzle 6.

The valve includes a shutter member 15 which is movable between a first position (shown in the drawing), in which it closes the fuel passage through the injection orifice 9, and a second position in which it leaves this passage open. This shutter member is fixed to a tubular armature 16 which can be attracted by the core 3 and is provided with an outer cylindrical surface 17 adapted to slide on a corresponding surface 18 of a bore in the body 1.

According to the invention the shutter member 15 is constituted by a disc 10 delimited by an outer cylindrical lateral surface 21 having substantially the same diameter as the outer surface 17 of the armature 16 and by a pair of flat circular surfaces, namely an upper surface 22 and a lower surface 23. This disc is provided with at least one axial hole 24 which passes completely through it and is connected to the armature 16 by means of laser welding 25 which is formed between the circular edge of the upper surface 22 of the disc and the corresponding edge of the lower surface of the armature 16.

Conveniently, the number of axial holes 24 in the disc 10 is equal to the number of injection orifices 9 which are formed in the wall 7 of the nozzle 6 increased by 1; moreover the overall section of the said holes in the disc is greater than the overall section of the injection orifices. Conveniently, as is clearly seen in FIG. 3, the axial holes 24 in the disc 10 are uniformly spaced around a circle centred on the axis of the disc. In the case of the embodiment illustrated there are provided five such holes whilst there are four injection orifices 9.

Moreover, as can be seen from FIG. 1, the armature 16 has an annular groove 26 formed within the armature itself close to its lower edge and communicating with the holes 24 in the disc 10.

The lower surface 23 of the disc 10 is normally held in contact against the upper surface of the wall 7 of the nozzle 6 by the action of the coil spring 27 which is disposed within the armature 16 and the core 3; the pre-load on the spring, which generates the pressure with which the disc 10 is pressed against the upper surface of the wall 7 of the nozzle depends on the position of a pin 28 forced into an axial hole 29 which passes through the disc 4 and the core 3. A sealing ring 30 is conveniently housed in a groove in the said pin.

Figure 2:
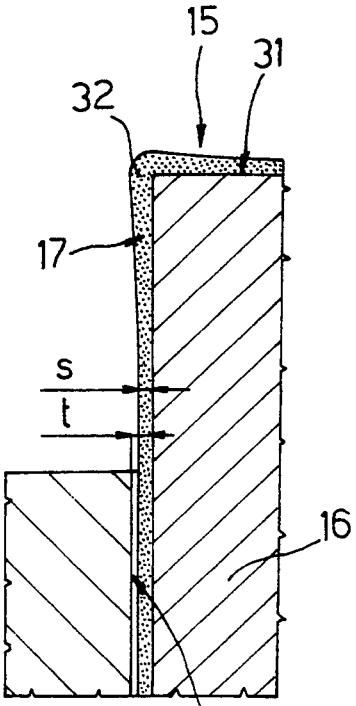
FIG. 2 is an enlarged detail of this section.

The outer cylindrical surface 17 of the armature 16 and the annular surface 31 (FIG. 2) which delimits the top of the armature itself are clad in a layer 32 of a galvanically deposited hard metal, for example, chrome or nickel; conveniently, the thickness 's' of the said layer lies between 15 and 25 microns. It has been found that when the armature 16 is covered with the layer 32 it can be produced with a very precise external diameter and with very close working tolerances, with the consequence of being able to control the radial clearance between the armature and the inner surface 18 of the hole in the body 1 in a rigorous manner; the said clearance defines, as is obvious, the air gap 't' between the armature and body, and the low value of the air gap 't' corresponds to a high magnet flux linkage between the body and armature.

Conveniently, the outer surface 17 of the armature 16 can be formed with annular grooves 20 (FIGS. 4 and 5) with a depth lying between 0.1 and 0.2 mm; the material of the layer 32 fills these grooves and in zone **32*a* adjacent to the grooves has a greater thickness; these zones 32*a*** therefore serve as guides.

On the upper surface of the wall 7 of the nozzle 6 is formed a pair of concentric annular projections 33 disposed around the injection orifices 9; the lower surface 23 of the disc rests on the upper surfaces of the said projections when the valve is in the closed position shown in FIG. 1. According to the invention the roughness of the said surfaces, which delimit the tops of the projections 33, lies between 0.08 and 0.12 microns; it has in fact been found that only when the roughness of this surface lies in the said range, is a perfect seal of the valve and, simultaneously, a high speed of response obtained; in fact, when the roughness falls below the indicated limit, whilst the seal remains good the response speed is insufficient because of the tendency of the lower surface 23 of the disc 10 to adhere to the corresponding surface of the wall 7, whilst when the roughness is greater than the above indicated limit, the seal becomes insufficient.

The nozzle 6 has at least one tooth 34 (FIGS. 1 and 6) which projects axially of the nozzle from the side wall thereof; in the embodiment illustrated there are provided two diametrically opposite teeth 34 which can be seen in FIG. 6. According to the invention the inclination of the axis of each of the injection orifices 9 is chosen in such a way that during injection of fuel through the orifice itself there is generated a fuel jet 35 (FIG. 1) having a direction such as to strike the surface 36 which internally delimits the tooth 34. This surface constitutes a portion of the inner surface 37 of the nozzle 6, which in the embodiment illustrated is a conical surface. Conveniently the teeth 34 are uniformly spaced around a circle centred on the axis of the nozzle 6, and the inclination of the axis of the injection orifices 9 is chosen in such a way that each of the fuel jets 35 thus generated has a direction such as to strike the surface 36 which internally delimits a corresponding tooth 34.

The valve is provided with holes 38 (FIG. 1) formed in the body 1 and communicating with the internal cavity within the body itself in which the electromagnet 2 is housed; these holes can be suitably screened by an annular filter 39; moreover other radial holes 40 are provided in the core 3.

The valve is closed at the top by a cap 41 in which are fitted electrical connection elements 42 connected to pins 43 in turn connected to the conductors of the electromagnet 2.

Finally, sealing rings 44 can be arranged to provide the valve seal within the seat in the engine on which the valve is mounted.

The valve described operates in the following manner.

Fuel enters into the valve through the holes 38 filling the cavity in which the electromagnet 2 is housed; from here the fuel enters into the interior cavity within the armature itself through the holes 40 in the core 3 and through the clearances between this latter and the armature 16; when the electromagnet 2 is activated and therefore the armature 16 is attracted by the core 3, the lower surface 23 of the disc 10 is separated from the surfaces of the radial projections 33 formed on the wall 7 of the nozzle 6 thereby allowing fuel to flow through the annular groove 26 formed in the armature 16 and through the holes 24 formed in the disc 10 into the injection orifices 9. In this way jets 35 of fuel are generated downstream from the injection orifices and, because of the inclination of the orifices themselves, these strike the surfaces 36 of the teeth 34 of the nozzle 6. In this way, because of the energy of the impact, each jet is atomised to mix with the flow of air passing through the fuel supply device on which the valve is fitted.

The speed of response of the valve of the invention is very high. This favourable result is due above all to the low mass of the parts which move with the shutter member 15, which are solely constituted by the disc 10 and the armature 16. Because of the very simple form of these parts and the manner in which the disc is connected to the armature, achieved by means of laser welding 25, the unit thus obtained has a very low mass. Moreover, a high response speed is also due to the very high magnetic flux linkage between the armature 16 and the body 1: this is due to the very small value of the air gap 't' obtainable due to the presence of the layer of hard metal 32 galvanically deposited on the outer lateral surface 17 of the armature 16.

Furthermore, the valve described seals the fuel very well. This is due essentially to the fact that the lower surface 23 of the disc 10 is perfectly perpendicular to the axis of the armature 16; this favourable result depends on the very simple form of the disc itself and the manner of connection (laser welding) of the disc to the armature; in fact the upper and lower surfaces 22, 23 of this disc can be ground with considerable precision and are perfectly parallel; similarly the outer lateral surface 21 of the disc can be worked with considerable precision and has a diameter substantially coincident with that of the outer surface 17 of the armature: in such conditions the disc 10 can be laser welded to the armature with high precision thus obtaining the above indicated advantages.

The presence of the coating layer 32 on the armature 16 also contributes to the valve seal: in fact, because of this layer a very small radial clearance 't' can be obtained with which it is possible to obtain an extremely precise guidance of the armature in the associated bore in the body 1 so as to maintain, during displacement of the shutter member 15, the lower surface 23 of the disc 10 perfectly parallel to the upper surface 7 of the nozzle 6. The roughness of the upper surface of the radial projections 33 also contributes to the good seal of the valve, which surface roughness is chosen within the range of roughness which has been indicated above.

The valve described has a very good reliability. This is due above all to the fact that the same functional characteristics which are found in the new valve are conserved even after extended periods of use of the valve. In fact the cladding layer 32, being made of very hard material, has a high resistance to wear which contributes to maintaining the air gap 't' unchanged. Even repeated impacts of the armature 16 against the core 3 do not detrimentally affect the wear of the armature because of the presence of this layer.

Furthermore the valve works satisfactorily in all working conditions. In particular the formation of fuel droplets downstream from the injection orifices 9 is prevented, which fuel droplets on separating from the internal surface 37 of the nozzle could enter the flow of mixture, detrimentally affecting the operating conditions of the engine, in particular the slow running conditions. This favourable result is due to the presence of the teeth 34 and the surfaces 36 which delimit the teeth themselves internally and against which the fuel jets 35 coming from the injection orifices 9 strike. Since, as has been stated, these jets only strike the surfaces 36 on such surfaces there is an effective atomization action of the jet, whilst the fuel which is not atomised and which remains adherent to the surfaces themselves does not tend to form droplets since they are immediately carried away in a successive injection cycle. In this way the deposition of fuel onto the surfaces 36 to give rise to a flow of fuel which moves tangentially to the surface 37 and which can give rise to the formation of droplets is prevented.

The structure of the valve described is very simple and therefore it can be made at low cost and with high working precision. This is due essentially to the very simple shape of the various components and to the manner in which these components are connected together.

It is clear that the embodiment of the valve of the present invention described can have modifications and variations introduced thereto both as far as the shape and arrangement of the various parts is concerned, without departing from the scope of the invention.

We claim:

1. An electromagnetically actuated fuel atomising and metering valve for a heat engine fuel supply device, comprising a metal body in which is housed an annular electromagnet and a core disposed within the electromagnet, an injection nozzle which is provided with at least one fuel injection orifice and which is fixed to said body, and a shutter member movable between a first position in which said shutter member closes a fuel passage through said at least one injection orifice and a second position in which said shutter member leaves said fuel passage open, said shutter member being fixed to a tubular armature which can be attracted by said core and being provided with a cylindrical outer lateral surface adapted to slide on a corresponding surface of a bore in said body, said shutter member including a disc delimited by a cylindrical outer lateral surface having substantially the same diameter as said outer surface of said armature, and by a pair of upper and lower flat circular surfaces, said disc being connected to said armature by laser welding formed between the circular edge of said upper surface of the disc and the corresponding edge of a lower surface of the armature, and said disc being provided with at least one axial hole passing through the disc, said armature having an internal annular groove formed close to said edge of the lower surface of the armature and communicating with said axial hole in the disc, and at least one annular groove formed on said outer cylindrical surface of said armature, said at least one annular groove having a depth between 0.1 and 0.2 mms, and said outer cylindrical surface of the armature and the annular surface which delimits the top of the armature are coated in a layer of galvanically deposited hard metal, the thickness of said layer of hard metal being between 15 and 25 microns.

2. The valve of claim 1 wherein said layer of hard metal is a layer comprising at least one of chrome and nickel.

3. The valve of claim 1 comprising a plurality of holes in the disc, wherein the number of said holes in the disc is one more than the number of said at least one injection orifice in said injection nozzle, the overall cross-section of said holes in the disc being greater than the overall cross-section of said at least one injection orifice.

4. The valve of claim 1 wherein said holes in said disc are spaced uniformly around a circle centered on the axis of the disc.

5. An electromagnetically actuated fuel atomising and metering valve for a heat engine fuel supply device, comprising a metal body in which is housed an annular electromagnet and a core disposed within the electromagnet, an injection nozzle which is provided with at least one fuel injection orifice and which is fixed to said body, and a shutter member movable between a first position in which said shutter member closes a fuel passage through said at least one injection orifice and a second position in which said shutter member leaves said fuel passage open, said shutter member being fixed to a tubular armature which can be attracted by said core and being provided with a cylindrical outer lateral surface adapted to slide on a corresponding surface of a bore in said body, said shutter member including a disc delimited by a cylindrical outer lateral surface having substantially the same diameter as said outer surface of said armature, and by a pair of upper and lower flat circular surfaces, said disc being connected to said armature by laser welding formed between the circular edge of said upper surface of the disc and the corresponding edge of a lower surface of the armature, and said disc being provided with at least one axial hole passing through the disc, said armature having an internal annular groove formed close to said edge of the lower surface of the armature and communicating with said axial hole in the disc, and said injection nozzle has an upper wall in which said at least one injection orifice is formed and a lateral wall of tubular form, said injection nozzle having at least one tooth projecting from said lateral wall in the direction of the axis of said injection nozzle, and the inclination of the axis of said at least one injection orifice is chosen in such a way that, during injection of fuel through said at least one injection orifice, a jet of fuel is generated having a direction such as to strike the surface which internally delimits said at least one tooth.

6. The valve of claim 5 wherein said injection nozzle has a plurality of teeth spaced uniformly around a circle centered on the axis of the injection nozzle, and the inclination of the axis of said at least one injection orifice is chosen in such a way that said fuel jet generated by said at least one injection orifice has a direction such as to strike the surface which internally delimits one of said teeth.

7. The valve of claim 5 comprising a plurality of holes in the disc, wherein the number of said holes in the disc is one more than the number of maid at least one injection orifice in said injection nozzle, the overall cross-section of said holes in the disc being greater than the overall cross-section of said at least one injection orifice.

8. The valve of claim 7 wherein said holes in said disc are spaced uniformly around a circle centered on the axis of the disc.

9. An electromagnetically actuated fuel atomising and metering valve for a heat engine fuel supply device, comprising a metal body in which is housed an annular electromagnet and a core disposed within the electromagnet, an injection nozzle which is provided with at least one fuel injection orifice and which is fixed to said body, and a shutter member movable between a first position in which said shutter member closes a fuel passage through said at least one injection orifice and a second position in which said shutter member leaves said fuel passage open, said shutter member being fixed to a tubular armature which can be attracted by said core and being provided with a cylindrical outer lateral surface adapted to slide on a corresponding surface of a bore in said body, said shutter member including a disc delimited by a cylindrical outer lateral surface having substantially the same diameter as said outer surface of said armature, and by a pair of upper and lower flat circular surfaces, said disc being connected to said armature by laser welding formed between the circular edge of said upper surface of the disc and the corresponding edge of a lower surface of the armature, and said disc being provided with at least one axial hole passing through the disc, said armature having an internal annular groove formed close to said edge of the lower surface of the armature and communicating with said axial hole in the disc, and a plurality of annular projections formed on an upper surface of said injection nozzle and around said at least one injection orifice, said annular projections adapted to allow contact of said lower surface of said disc, the roughness of annular surfaces which delimit the top of said projections and said lower surface of the disc being between 0.08 and 0.12 microns.

10. The valve of claim 9 comprising a plurality of holes in the disc, wherein the number of said holes in the disc is one more than the number of said at least one injection orifice in said injection nozzle, the overall cross-section of said holes in the disc being greater than the overall cross-section of said at least one injection orifice.

11. The valve of claim 10 wherein said holes in said disc are spaced uniformly around a circle centered on the axis of the disc.

* * * * *